US008960061B1

(12) United States Patent
Williams et al.

(10) Patent No.: US 8,960,061 B1
(45) Date of Patent: Feb. 24, 2015

(54) SLIDE LOCK FOR SHEET CUTTING

(76) Inventors: Sharon Lee Williams, Scottsburg, OR (US); Earl Leroy Williams, Scottsburg, OR (US)

( * ) Notice: Subject to any disclaimer, the term of this patent is extended or adjusted under 35 U.S.C. 154(b) by 817 days.

(21) Appl. No.: 13/250,113

(22) Filed: Sep. 30, 2011

(51) Int. Cl.
*B26D 7/02* (2006.01)
*B26D 1/14* (2006.01)
*B25B 1/22* (2006.01)

(52) U.S. Cl.
USPC ..... 83/455; 83/485; 83/459; 269/74

(58) Field of Classification Search
USPC ..... 269/74, 266, 71, 43, 254 CS, 246, 271; 83/455, 459, 387, 485
See application file for complete search history.

(56) References Cited

U.S. PATENT DOCUMENTS 1,657,687 A 1/1928 Schuler
3,977,103 A 8/1976 Strickland
4,685,366 A 8/1987 Beder
5,271,305 A 12/1993 Peters et al.
5,357,836 A * 10/1994 Stromberg et al. ..... 83/698.31
6,182,549 B1 2/2001 Albright et al.
6,966,247 B2 * 11/2005 Tseng ..... 83/455
7,617,751 B2 11/2009 James et al.
2004/0143979 A1 7/2004 Albright et al.
2004/0226426 A1 * 11/2004 Tseng ..... 83/455
2004/0231173 A1 11/2004 Baker
2006/0179989 A1 8/2006 James et al.

* cited by examiner

*Primary Examiner* — Lee D Wilson
*Assistant Examiner* — Seahee Yoon
(74) *Attorney, Agent, or Firm* — Jerry Haynes Law

(57) ABSTRACT

A slide lock includes a slide lock base having a plurality of grip element openings; a slide lock handle carried by the slide lock base and positional in a released position and a locked position relative to the slide lock base; and a plurality of grip elements carried by the slide lock handle and disposed in the grip element openings, respectively. The grip elements are retracted in the grip element openings, respectively, when the slide lock handle is in the released position and the grip elements protrude from the grip element openings, respectively, when the slide lock handle is in the locked position.

16 Claims, 5 Drawing Sheets

SLIDE LOCK FOR SHEET CUTTING

FIELD OF THE INVENTION

The disclosure generally relates to devices used to cut sheet material such as fabric. More particularly, the disclosure relates to a slide lock which securely holds a sheet of fabric or other material in place against a support surface for cutting to ensure that the material is uniformly cut along straight lines.

BACKGROUND OF THE INVENTION

Quilting is a popular worldwide pastime. Over the years, the art of quilting has undergone numerous changes. These changes include the use of new and better quilting fabrics, techniques and tools. One type of tool which is extensively used by quilting enthusiasts is the rotary cutter, which includes a rotatable round blade attached to a handle. The rotary cutter can be used to cut multiple fabric pieces out of a sheet of fabric material at the same time. The cut fabric pieces are sewn together in a selected pattern to form the quilt.

One of the drawbacks of using a rotary cutter to cut pieces of fabric from a fabric sheet includes the difficulty of accurately cutting all the fabric pieces to a uniform and exact size as may be required for knitting of a quilt. Therefore, a cutting guide such as a ruler which enables the rotary cutter to cut the fabric in a straight line may be necessary. This procedure requires that the quilter place his or her hand at the center of the ruler, press down as hard as possible and begin cutting the fabric sheet in a straight line along the edge of the ruler using the rotary cutter. Depending on the length of the fabric sheet which is being cut, however, this process may require that the cutting process be periodically stopped as the quilter repositions his or her hand further along the ruler. This repositioning effort may result in inadvertent sliding of the ruler in a sideways motion and consequently, uneven cutting of the fabric sheet. Although it may be possible to trim the cut fabric piece or strip to the desired size using this procedure, it is frequently necessary that the incorrectly-cut pieces be discarded.

Accordingly, a slide lock which holds a sheet of fabric or other material in place against a support surface as the material is cut to ensure that the material is uniformly cut along straight lines is needed.

SUMMARY OF THE INVENTION

The disclosure is generally directed to a slide lock which holds a sheet of fabric or other material in place against a support surface as the material is cut to ensure that the material is uniformly cut along straight lines. An illustrative embodiment of the slide lock includes a slide lock base having a plurality of grip element openings; a slide lock handle carried by the slide lock base and positional in a released position and a locked position relative to the slide lock base; and a plurality of grip elements carried by the slide lock handle and disposed in the grip element openings, respectively. The grip elements are retracted in the grip element openings, respectively, when the slide lock handle is in the released position and the grip elements protrude from the grip element openings, respectively, when the slide lock handle is in the locked position.

BRIEF DESCRIPTION OF THE DRAWINGS

The disclosure will now be described, by way of example, with reference to the accompanying drawings, in which.

DETAILED DESCRIPTION

Figure 1:
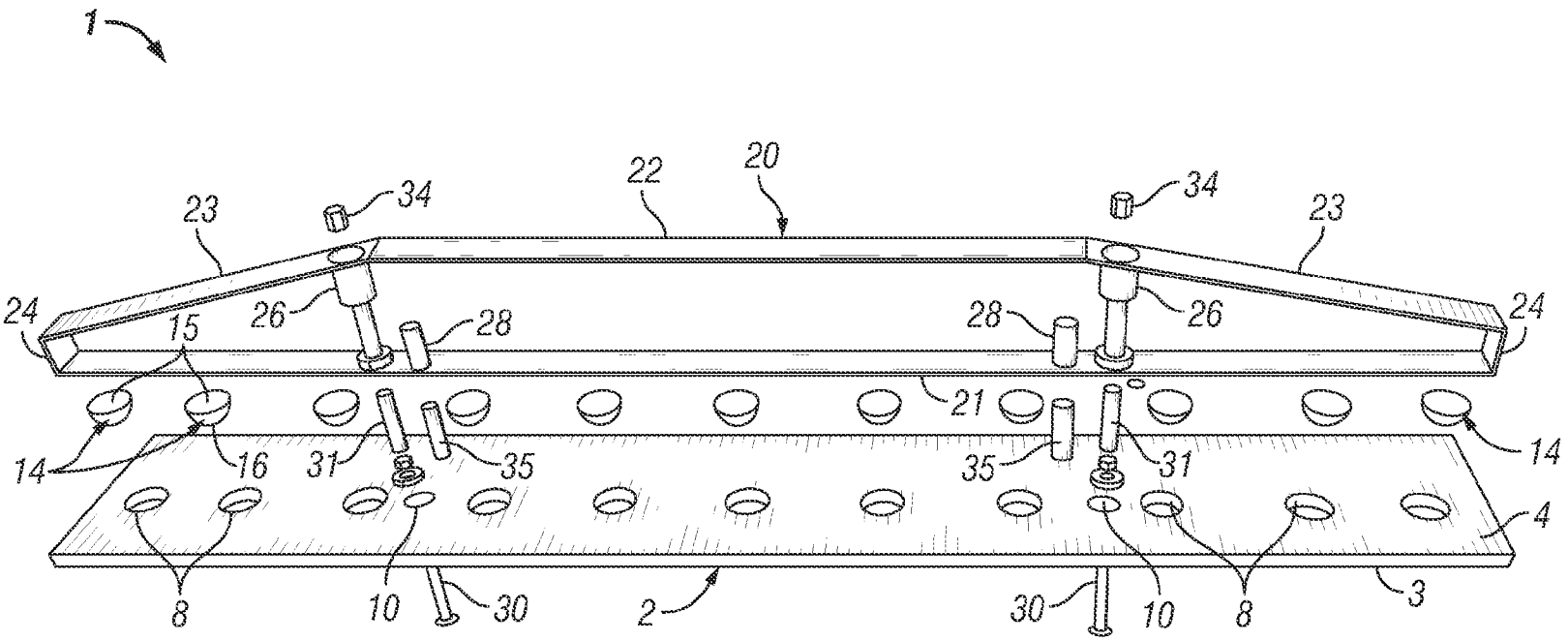
FIG. 1 is an exploded front perspective view of an illustrative embodiment of the slide lock for sheet cutting.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Relative terms such as "upper" and "lower" are used for descriptive purposes only herein and shall not be construed in a limiting sense. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1-8 of the drawings, an illustrative embodiment of the slide lock for sheet cutting, hereinafter slide lock, is generally indicated by reference numeral 1. The slide lock 1 includes a slide lock base 2 which may be generally elongated. The slide lock base 2 may be wood, metal, plastic and/or other rigid material and may include a generally flat or planar base lower surface 3 and a generally flat or planar base upper surface 4. Multiple grip element openings 8 may extend through the slide lock base 2 from the base upper surface 4 to the base lower surface 3. The grip element openings 8 may be disposed in spaced-apart, adjacent relationship to each other. In some embodiments, the slide lock base 2 may have 11 grip element openings 8 which may be generally equally-spaced with respect to each other along the length of the slide lock base 2, as illustrated. In other embodiments, the slide lock base 2 may have as few as two or more than 11 grip element openings 8.

A slide lock handle 20 is provided on the slide lock base 2. The slide lock handle 20 may be generally elongated with a generally flat or planar grip element engaging surface 21 and an exposed handle surface 22. In some embodiments, the slide lock handle 20 may have a pair of beveled handle surfaces 23 which extend from opposite ends of the exposed handle surface 22. Side handle edges 24 may extend between the grip element engaging surface 21 and the corresponding beveled handle surface 23. The slide lock handle 20 may be wood, metal, plastic and/or other rigid material.

Figure 2:
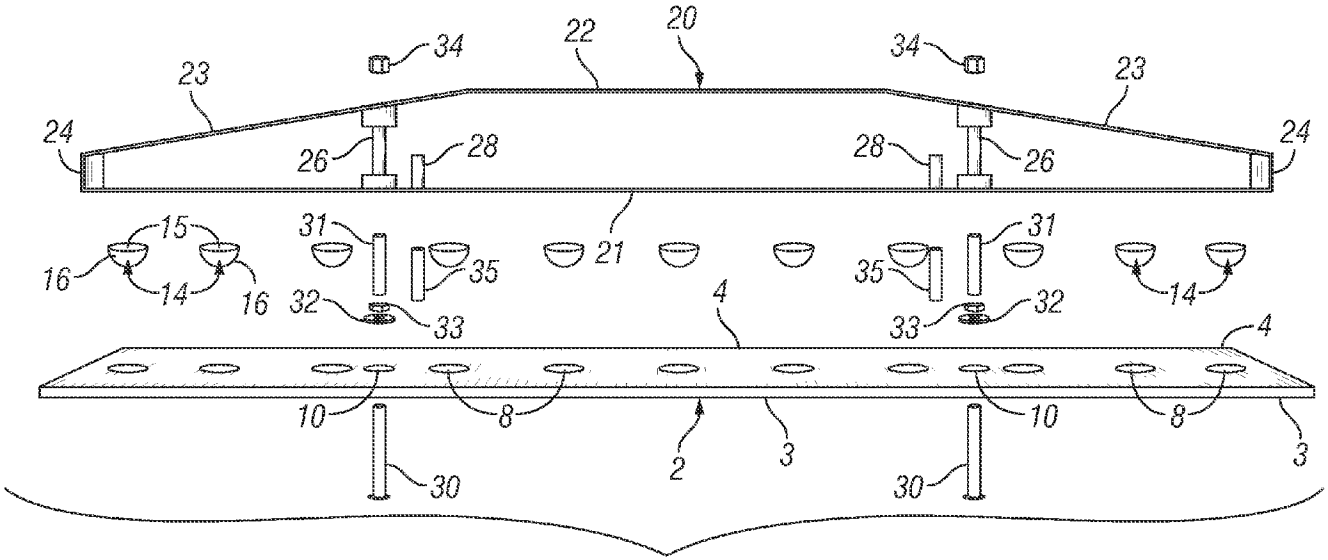
FIG. 2 is an exploded front perspective view of an illustrative embodiment of the slide lock.
Figure 2A:
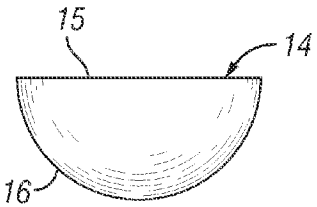
FIG. 2A is a side view of an exemplary grip element of an illustrative embodiment of the slide lock.
Figure 3:
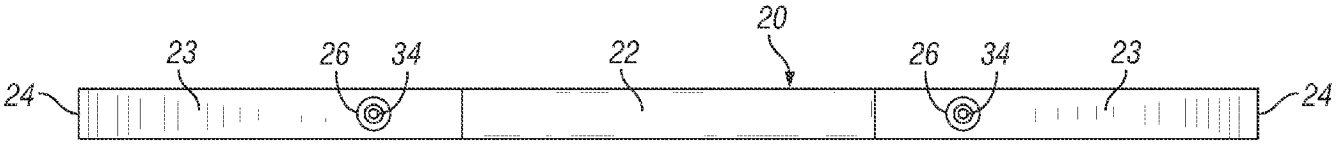
FIG. 3 is a top view of an exemplary slide lock handle of an illustrative embodiment of the slide lock.
Figure 4:
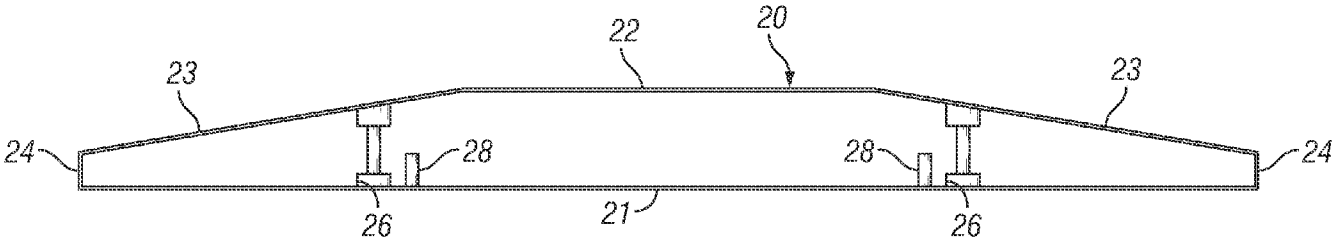
FIG. 4 is a front view of the exemplary slide lock handle.
Figure 5:
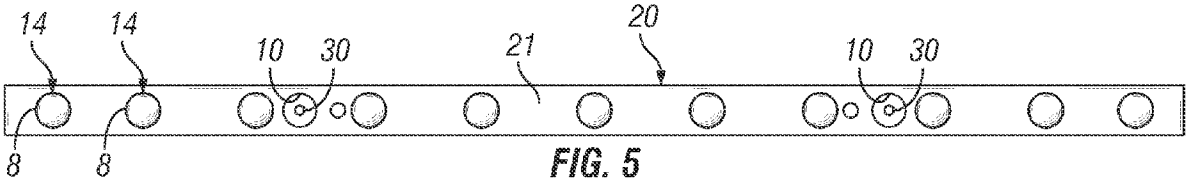
FIG. 5 is a bottom view of the exemplary slide lock handle.

Multiple grip elements 14 are provided on the grip element engaging surface 21 of the slide lock handle 20. The grip elements 14 register with and insert into the respective grip element openings 8 in the slide lock base 2. Each grip element 14 may be a resilient, deformable material such as polyurethane, for example and without limitation. As illustrated in FIG. 2A, each grip element 14 may generally have the shape of a dome or a half-globe with a generally convex gripping surface 16 and a generally flat or planar handle attachment surface 15 which is opposite the gripping surface 16 and attached to the grip element engaging surface 21 of the slide lock handle 20 using glue and/or other suitable attachment technique known by those skilled in the art. As illustrated in FIGS. 1 and 2, each grip element 14 may be oriented in each corresponding grip element opening 8 with the handle attachment surface 15 disposed generally at the base upper surface 4 and the gripping surface 16 disposed generally at the base lower surface 3 of the slide lock base 2.

Figure 6:
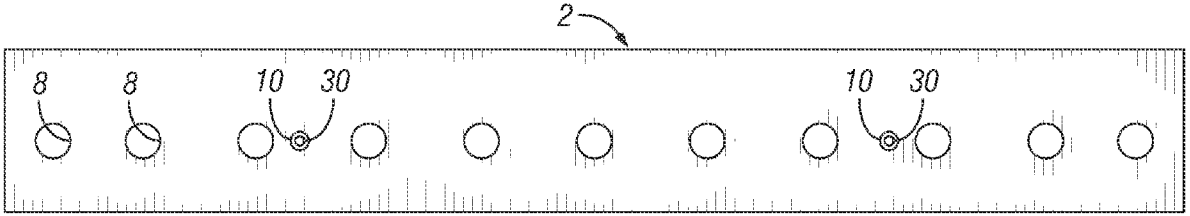
FIG. 6 is a bottom view of an exemplary slide lock base of an illustrative embodiment of the slide lock.

At least one fastener opening 10 may extend through the slide lock base 2. In some embodiments, a pair of fastener openings 10 may extend through the slide lock base 2 in spaced-apart relationship to each other, as illustrated in FIGS. 1, 2 and 6. At least one fastener opening 26 may extend through the slide lock handle 20 from the grip element engaging surface 21 to the exposed handle surface 22 of the slide lock handle 20. A bushing 31 may be provided in each fastener opening 26. Each handle fastener 30 may extend through the corresponding fastener opening 10 in the slide lock base 2 and through the corresponding and registering bushing 31 in the fastener opening 26. As illustrated in FIG. 2, a washer 32 and a nut 33 may be placed on each handle fastener 30. A lock nut 34 may be threaded on each handle fastener 30 inside the fastener opening 26 to loosely secure the slide lock handle 20 on the slide lock base 2.

The slide lock handle 20 may be loosely mounted on the slide lock base 2 in such a manner that the slide lock handle 20 can be selectively deployed in a raised or released position (FIG. 7) or a lowered or locked position (FIG. 8) with respect to the slide lock base 2. In the released position, a handle gap 38 (FIG. 7) may normally exist between the slide lock base 2 and the slide lock handle 20. At least one handle spring 35 (FIGS. 1 and 2) may be interposed between the slide lock base 2 and the slide lock handle 20 to normally bias the slide lock handle 20 in the released position. Depression of the slide lock handle 20 against the slide lock base 2 from the released position in FIG. 7 to the locked position in FIG. 8 closes the handle gap 38 and facilitates protrusion of the gripping surfaces 16 on the respective grip elements 14 through the respective grip element openings 8 (FIGS. 1 and 2) and beyond the base lower surface 3 of the slide lock base 2, as illustrated in FIG. 8. Conversely, release of downward pressure from the slide lock handle 20 causes the handle spring or springs 35 to return the slide lock handle 20 to the raised released position of FIG. 7 and facilitates retraction of the gripping surfaces 16 of the grip elements 14 into the respective grip element openings 8. As illustrated in FIGS. 1 and 2, in some embodiments, each handle spring 35 may be seated in a corresponding spring cavity 28 which is recessed into the grip element engaging surface 21 of the slide lock handle 20. The end of the handle spring 35 which protrudes from the spring cavity 28 engages the base upper surface 4 of the slide lock base 2.

Figure 7:
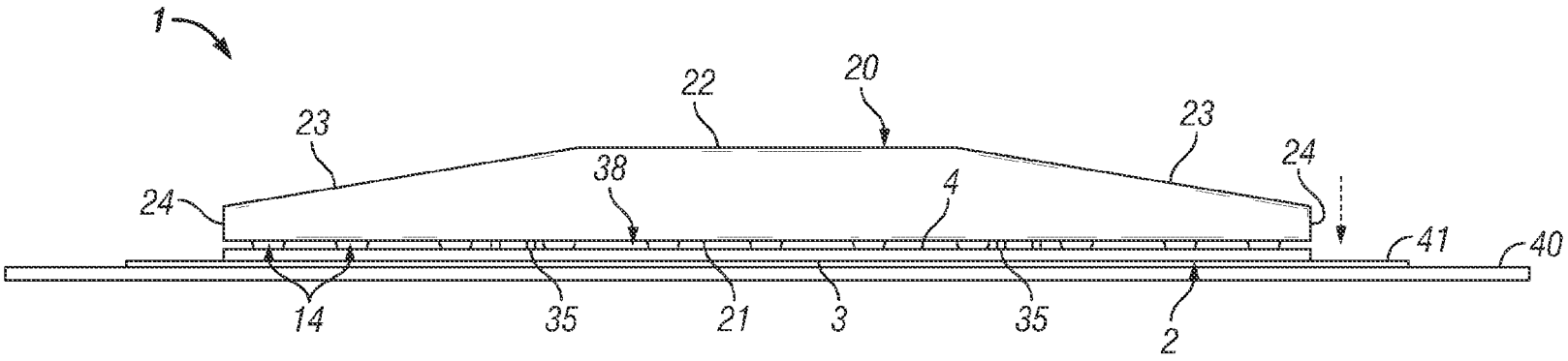
FIG. 7 is a front view of an illustrative embodiment of the slide lock in exemplary application thereof, with the slide lock initially disengaging a fabric sheet on a support surface.
Figure 8:
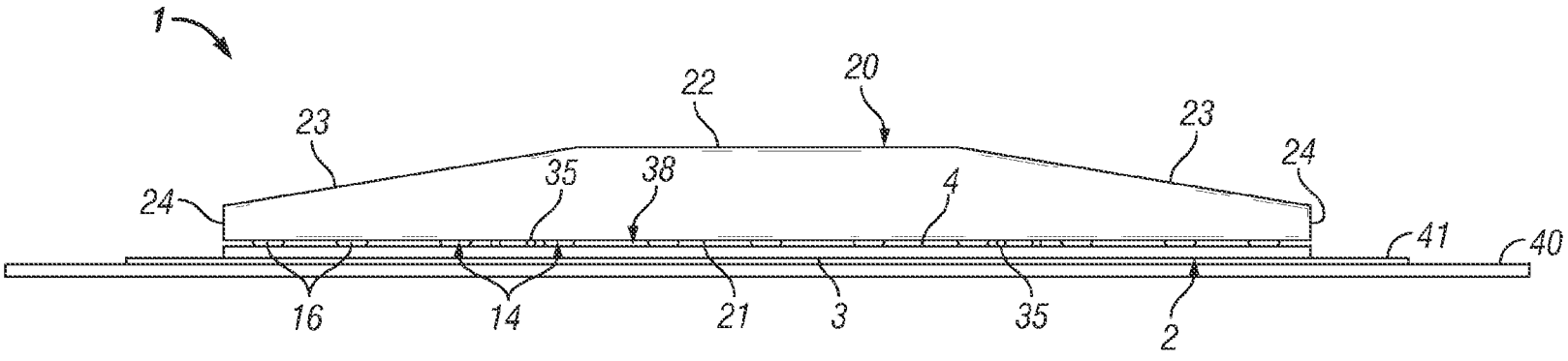
FIG. 8 is a front view of an illustrative embodiment of the slide lock in exemplary application thereof, with the slide lock engaging and securely holding the fabric sheet against the support surface for uniform cutting of the sheet along the slide lock.
Figure 9:
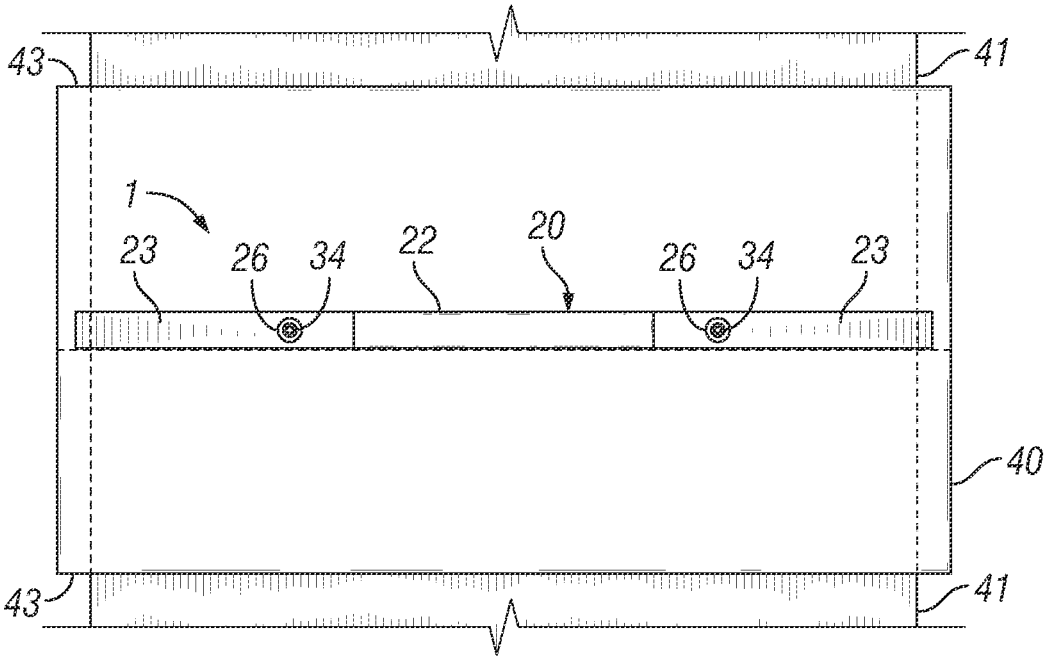
FIG. 9 is a top view of an illustrative embodiment of the slide lock in exemplary application thereof, with the slide lock placed on a material sheet preparatory to cutting of the sheet.
Figure 10:
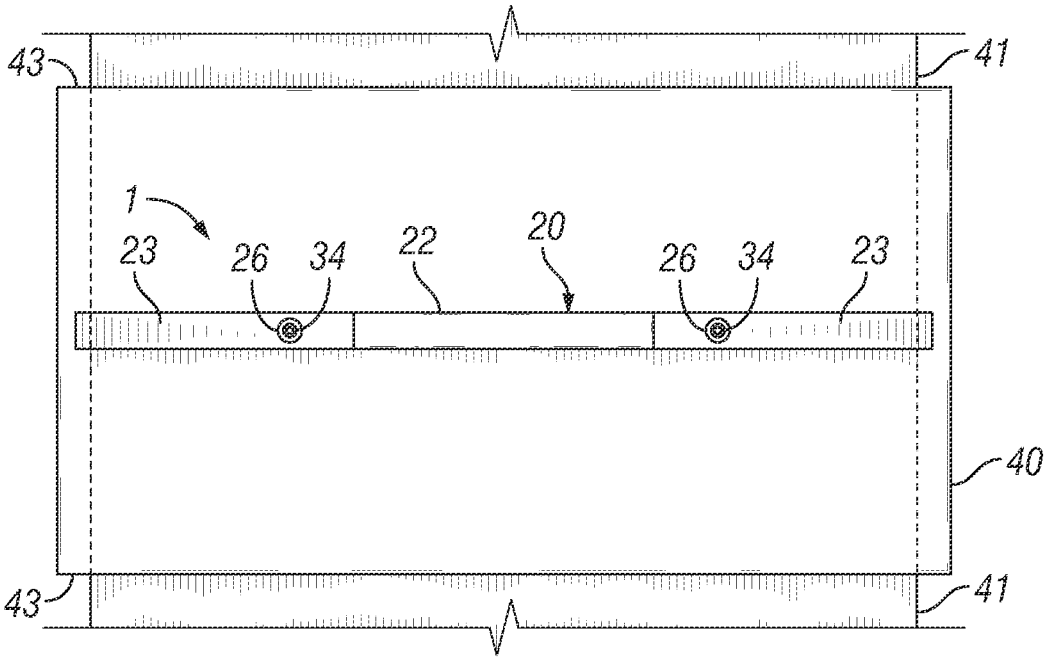
FIG. 10 is a top view of an illustrative embodiment of the slide lock in exemplary application thereof after cutting of a piece of the material sheet.

Referring next to FIGS. 7-10 of the drawings, in exemplary application the slide lock 1 may be used to facilitate uniform and straight cutting of a material sheet 41. In some applications, the material sheet 41 may be a fabric sheet which is cut for quilting applications. Accordingly, the material sheet 41 which is to be cut is initially placed on a flat support surface 40. As illustrated in FIG. 7, with the slide lock handle 20 of the slide lock 1 initially deployed in the released position, the slide lock base 2 is placed on the material sheet 41. The slide lock base 2 is oriented along the desired cut line 43 (FIG. 9) which is to be cut in the material sheet 41. Next, the slide lock handle 20 is manually depressed against the bias which is imparted by the handle spring or springs 35 (FIGS. 1 and 2) from the released position of FIG. 7 to the locked position of FIG. 8. Therefore, the slide lock handle 20 pushes the grip elements 14 and the convex gripping surfaces 16 of the grip elements 14 protrude from the respective grip element openings 8 in the slide lock base 2 against the material sheet 41, as illustrated in FIG. 8. Thus, the grip elements 14 tightly engage the material sheet 41 and securely hold the material sheet 41 against the support surface 40. A cutting implement (not illustrated) such as a conventional rotary cutter, for example and without limitation, may then be used to cut the material sheet 41 along the cut line 43. It will be appreciated by those skilled in the art that the slide lock 1 is amenable to use by right-handed or left-handed persons and prevents sideways and other movement of the material sheet 41 and the cutting implement during the cutting operation. Moreover, the slide lock base 2 of the slide lock 1 may serve as a template for the cutting implement and facilitates uniform, precise and straight cutting of the material sheet 41 along the cut line 43 for quilting or other applications. As illustrated in FIG. 10, after the cutting operation, the cut piece 42 is separated from the material sheet 41 from which it was cut. Downward pressure against the slide lock handle 20 may then be released such that the handle spring or springs 35 return the slide lock handle 20 to the released position of FIG. 7. Simultaneously, the grip elements 14 disengage the material sheet 41 and retract into the respective grip element openings 8 in the slide lock base 2. The slide lock 1 can then be slid along the material sheet 41 and repositioned to cut another piece 42 from the material sheet 41, as desired.

While illustrative embodiments of the disclosure have been described above, it will be recognized and understood that various modifications can be made and the appended claims are intended to cover all such modifications which may fall within the spirit and scope of the disclosure.

What is claimed is:

1. A slide lock comprising:

a slide lock base having a plurality of grip element openings;

a slide lock handle carried by the slide lock base and positional in a released position and a locked position relative to the slide lock base;

a plurality of generally dome-shaped grip elements carried by the slide lock handle and disposed in the grip element openings, respectively, of the slide lock base;

wherein the grip elements comprise generally planar handle attachment surfaces carried by the slide lock handle and generally convex gripping surfaces opposite the handle attachment surfaces, respectively; and wherein the gripping surfaces, respectively, of the grip elements are retracted in the grip element openings, respectively, of the slide lock base when the slide lock handle is in the released position and the convex gripping surfaces of the grip elements protrude from the grip element openings, respectively, when the slide lock handle is in the locked position.

2. The slide lock of claim 1 further comprising at least one handle spring interposed between the slide lock base and the slide lock handle.

3. The slide lock of claim 2 further comprising at least one spring cavity in the slide lock handle and wherein the at least one handle spring is seated in the at least one spring cavity.

4. The slide lock of claim 1 wherein each of the grip elements comprises a resilient, deformable material.

5. The slide lock of claim 4 wherein the resilient, deformable material comprises polyurethane.

6. The slide lock of claim 1 wherein the slide lock handle comprises a generally flat or planar grip element engaging surface and wherein the grip elements are carried by the grip element engaging surface.

7. A slide lock comprising:

a generally elongated slide lock base having a generally planar base first surface, a generally planar base second surface opposite the base first surface and a plurality of grip element openings extending from the base first surface to the base second surface;

at least one handle fastener carried by the slide lock base;

a slide lock handle carried by the at least one handle fastener and positional in a released position and a locked position relative to the slide lock base;

a plurality of grip elements carried by the slide lock handle and disposed in the grip element openings, respectively, of the slide lock base;

wherein each of the grip elements is generally dome-shaped; and wherein the grip elements are retracted in the grip element openings, respectively, of the slide lock base when the slide lock handle is in the released position and the grip elements protrude from the grip element openings, respectively, when the slide lock handle is in the locked position.

8. The slide lock of claim 7 further comprising at least one handle spring interposed between the slide lock base and the slide lock handle.

9. The slide lock of claim 8 further comprising at least one spring cavity in the slide lock handle and wherein the at least one handle spring is seated in the at least one spring cavity.

10. The slide lock of claim 7 wherein each of the grip elements comprises a resilient, deformable material.

11. The slide lock of claim 10 wherein the resilient, deformable material comprises polyurethane.

12. The slide lock of claim 7 wherein the slide lock handle comprises a generally flat or planar grip element engaging surface and wherein the grip elements are carried by the grip element engaging surface.

13. The slide lock of claim 12 wherein each of the grip elements comprises a generally flat or planar handle attachment surface carried by the grip element engaging surface of the slide lock handle and a generally convex gripping surface opposite the handle attachment surface.

14. A slide lock comprising:

a generally elongated slide lock base having a generally planar base first surface, a generally planar base second surface opposite the base first surface and a plurality of grip element openings extending from the base first surface to the base second surface;

at least one handle fastener carried by the slide lock base;

a slide lock handle carried by the at least one handle fastener and positional in a released position and a locked position relative to the slide lock base, with a handle gap between the slide lock base and the slide lock handle when the slide lock handle is in the released position;

at least one handle spring between the slide lock base and the slide lock handle and normally biasing the slide lock handle in the released position;

a plurality of generally dome-shaped grip elements carried by the slide lock handle and disposed in the grip element openings, respectively, of the slide lock base;

wherein each of the grip elements comprises a resilient, deformable material;

wherein the grip elements comprise generally planar handle attachment surfaces carried by the slide lock handle and generally convex gripping surfaces opposite the handle attachment surfaces, respectively; and wherein the gripping surfaces, respectively, of the grip elements are retracted in the grip element openings, respectively, of the slide lock base when the slide lock handle is in the released position and the convex gripping surfaces of the grip elements protrude from the grip element openings, respectively, when the slide lock handle is in the locked position.

15. The slide lock of claim 14 further comprising at least one spring cavity in the slide lock handle and wherein the at least one handle spring is seated in the at least one spring cavity.

16. The slide lock of claim 14 wherein the slide lock handle comprises a generally flat or planar grip element engaging surface and wherein the grip elements are carried by the grip element engaging surface.

* * * * *